US009721508B2

(12) United States Patent
Sun et al.

(10) Patent No.: US 9,721,508 B2
(45) Date of Patent: Aug. 1, 2017

(54) PIXEL CIRCUIT AND DRIVING METHOD THEREOF, ORGANIC LIGHT-EMITTING DISPLAY DEVICE

(71) Applicants: Shanghai Tianma AM-OLED Co., Ltd., Shanghai (CN); Tianma Micro-electronics Co., Ltd., Shenzhen (CN)

(72) Inventors: Kuo Sun, Shanghai (CN); Wang Li, Shanghai (CN); Dong Qian, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 1 day.

(21) Appl. No.: 15/006,520

(22) Filed: Jan. 26, 2016

(65) Prior Publication Data

US 2017/0110054 A1 Apr. 20, 2017

(30) Foreign Application Priority Data

Oct. 14, 2015 (CN) ..... 2015 1 0660444

(51) Int. Cl.
*G09G 5/00* (2006.01)
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0809* (2013.01);
(Continued)

(58) Field of Classification Search
CPC ..... G09G 3/3258; G09G 3/3291; G09G 2300/0809; G09G 2310/0202; G09G 2320/0646
See application file for complete search history.

(56) References Cited

U.S. PATENT DOCUMENTS

2014/0152642 A1* 6/2014 Kim ..... G09G 3/3233 345/212
2016/0225829 A1* 8/2016 Wu ..... G06F 3/042

FOREIGN PATENT DOCUMENTS

CN 103077680 A 5/2013

* cited by examiner

*Primary Examiner* — Adam R Giesy
(74) *Attorney, Agent, or Firm* — Anova Law Group, PLLC

(57) ABSTRACT

A pixel circuit, a driving method of a pixel circuit and an organic light-emitting display device are provided. The pixel circuit includes a first transistor having a gate electrode receiving a first light-emitting signal, a first terminal receiving a first reference voltage, and a second terminal connected to a first node; a second transistor having a gate electrode receiving a first scanning signal, a first terminal receiving a second reference voltage, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage, and a second terminal connected to the third node; a seventh transistor having a gate electrode receiving the second light-emitting signal, a first terminal receiving the first power supply voltage, and a second terminal connected to the first node; an eighth transistor having a gate electrode receiving the second light-emitting signal and a first terminal connected to the fourth node; a
(Continued)

light-emitting element having a first terminal connected to the second terminal of the eighth transistor and a second terminal receiving a second power supply voltage; and a first capacitor having a first terminal connected to the first node and a second terminal connected to the second node.

20 Claims, 4 Drawing Sheets

(52) U.S. Cl.
CPC ..... *G09G 2310/0202* (2013.01); *G09G 2320/0646* (2013.01)

PIXEL CIRCUIT AND DRIVING METHOD THEREOF, ORGANIC LIGHT-EMITTING DISPLAY DEVICE

CROSS-REFERENCES TO RELATED APPLICATIONS

This application claims the priority of Chinese patent application No. CN201510660444.2, filed on Oct. 14, 2015, the entire content of which is incorporated herein by reference.

FIELD OF THE DISCLOSURE

The present disclosure relates to the field of display technology and, more particularly, relates to a pixel circuit and a driving method thereof, and corresponding organic light-emitting display device including the pixel circuit.

BACKGROUND

Display devices using light-emitting diodes have been proposed. In this type of display device, each pixel usually ha a pixel circuit and a light-emitting diode driven by the pixel circuit. Luminance of the light-emitting diode is usually determined by a voltage of a power supply and a data signal voltage. Power supply wiring which transfers the power supply voltage is greatly affected by a voltage drop in the power supply voltage. Such a voltage drop in the power supply voltage causes a luminance non-uniformity across a display screen.

Meanwhile, transistors in the pixel circuits have threshold voltage variations, which may cause undesired visible display artifacts. Thus, a threshold compensation is required. Accordingly, the complexity and the cost of the pixel circuit increase.

The disclosed pixel circuit and driving method are directed to solve one or more problems in the art.

BRIEF SUMMARY OF THE DISCLOSURE

One aspect of the present disclosure provides a pixel circuit. The pixel circuit includes a first transistor having a gate electrode receiving a first light-emitting signal, a first terminal receiving a first reference voltage, and a second terminal connected to a first node; a second transistor having a gate electrode receiving a first scanning signal, a first terminal receiving a second reference voltage, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage, and a second terminal connected to the third node; a seventh transistor having a gate electrode receiving the second light-emitting signal, a first terminal receiving the first power supply voltage, and a second terminal connected to the first node; an eighth transistor having a gate electrode receiving the second light-emitting signal, and a first terminal connected to the fourth node; a light-emitting element having a first terminal connected to the second terminal of the eighth transistor and a second terminal receiving a second power supply voltage; and a first capacitor having a first terminal connected to the first node and a second terminal connected to the second node.

Another aspect of the present disclosure provides an organic light-emitting display device. The organic light-emitting display device includes a plurality of scanning lines transferring a scanning signal, a plurality of data lines transferring a data signal, and a plurality of pixel circuits disposed at interactions of the plurality of scanning lines and the plurality of data lines. The pixel circuit further includes a first transistor having a gate electrode receiving a first light-emitting signal, a first terminal receiving a first reference voltage, and a second terminal connected to a first node; a second transistor having a gate electrode receiving a first scanning signal, a first terminal receiving a second reference voltage, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage, and a second terminal connected to the third node; a seventh transistor having a gate electrode receiving the second light-emitting signal, a first terminal receiving the first power supply voltage, and a second terminal connected to the first node; an eighth transistor having a gate electrode receiving the second light-emitting signal, and a first terminal connected to the fourth node; a light-emitting element having a first terminal connected to the second terminal of the eighth transistor and a second terminal receiving a second power supply voltage; and a first capacitor having a first terminal connected to the first node and a second terminal connected to the second node.

Another aspect of the present disclosure provides a driving method of a pixel circuit. The pixel circuit includes a first transistor having a gate electrode receiving a first light-emitting signal, a first terminal receiving a first reference voltage, and a second terminal connected to a first node; a second transistor having a gate electrode receiving a first scanning signal, a first terminal receiving a second reference voltage, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage, and a second terminal connected to the third node; a seventh transistor having a gate electrode receiving the second light-emitting signal, a first terminal receiving the first power supply voltage, and a second terminal connected to the first node; an eighth transistor having a gate electrode receiving the second light-emitting signal, and a first terminal connected to the fourth node; a light-emitting element having a first terminal connected to the second terminal of the eighth transistor and a second terminal receiving a second power supply voltage; and a first capacitor having a first terminal connected to the first node and a second terminal connected to the second node. The driving method includes at a first time period, providing the first light-emitting signal to the first transistor, such that the first reference voltage is transferred to the first node, providing the first scanning signal to the second transistor, such that the second reference voltage is transferred to the second node. The driving method includes at a second time period, providing the second scanning signal to the fourth transistor, such that the data signal is transferred to the third node, providing the second scanning signal to the fifth transistor, such that the second reference voltage is transferred to the second node. The driving method also includes at a third time period, providing the second light-emitting signal to the seventh transistor, such that the first power supply voltage is transferred to the first node, wherein the second node has a same electric potential change as the first node.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention.

Figure 1:
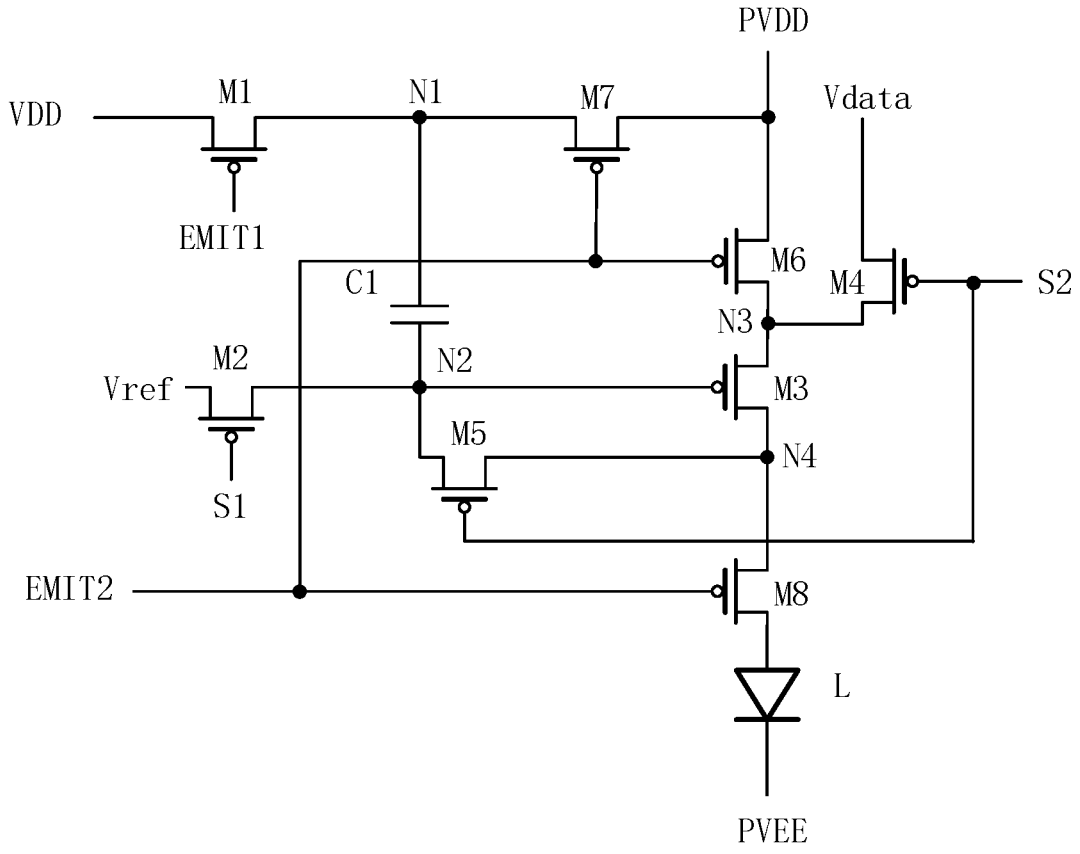
FIG. 1 illustrates an exemplary pixel circuit consistent with disclosed embodiments.

FIG. 1 illustrates an exemplary pixel circuit consistent with disclosed embodiments. As shown in FIG. 1, the pixel circuit may include a first transistor M1, a second transistor M2, a third transistor M3, a fourth transistor M4, a fifth transistor M5, a sixth transistor M6, a seventh transistor M7, an eighth transistor M8, a light-emitting element L and a first capacitor C1.

In particular, the first transistor M1 may have a gate electrode receiving a first light-emitting signal EMIT1, a first terminal receiving a first reference voltage VDD, and a second terminal connected to a first node N1.

The second transistor M2 may have a gate electrode receiving a first scanning signal S1, a first terminal receiving a second reference voltage Vref, and a second terminal connected to a second node N2.

The third transistor M3 may have a gate electrode connected to the second node N2, a first terminal connected to a third node N3, and a second terminal connected to a fourth node N4.

The fourth transistor M4 may have a gate electrode receiving a second scanning signal S2, a first terminal receiving a data signal Vdata, and a second terminal connected to the third node N3.

The fifth transistor M5 have a gate electrode receiving the second scanning signal S2, a first terminal connected to the fourth node N4, and a second terminal connected to the second node N2.

The sixth transistor M6 may have a gate electrode receiving a second light-emitting signal EMIT2, a first terminal receiving a first power supply voltage PVDD, and a second terminal connected to the third node N3.

The seventh transistor M7 may have a gate electrode receiving the second light-emitting signal EMIT2, a first terminal receiving the first power supply voltage PVDD, and a second terminal connected to the first node N1.

The eighth transistor M8 may have a gate electrode receiving the second light-emitting signal EMIT2, a first terminal connected to the fourth node N4, and a second terminal connected to the light-emitting element L.

The light-emitting element L may have a first terminal connected to the second terminal of the eighth transistor M8, and a second terminal receiving a second power supply voltage PVEE.

The first capacitor C1 may have a first terminal connected to the first node N1 and a second terminal connected to the second node N2.

Figure 2:
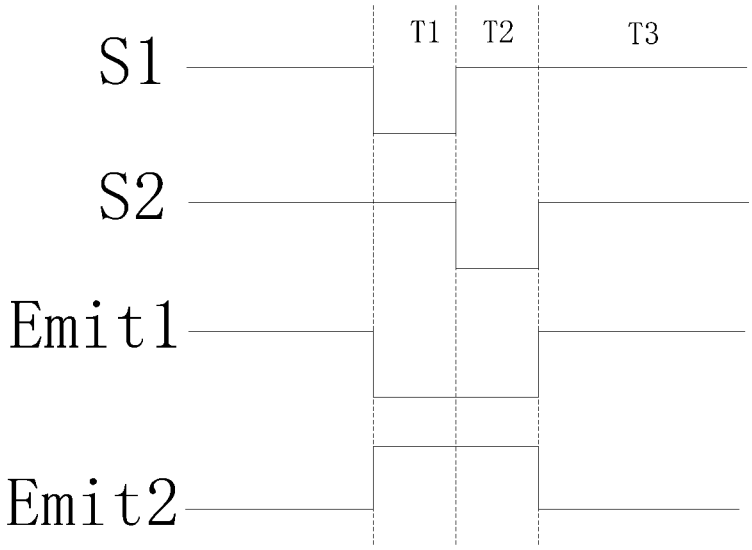
FIG. 2 illustrates an exemplary driving scheme of an exemplary pixel circuit in FIG. 1 consistent with disclosed embodiments.

FIG. 2 illustrates an exemplary driving scheme of an exemplary pixel circuit in FIG. 1 consistent with disclosed embodiments. A driving method of a pixel circuit consistent with disclosed embodiments is also provided, which is illustrated based on FIG. 1 and FIG. 2 as following.

As shown in FIG. 2, the driving scheme of the pixel circuit may include a first time period T1, a second time period T2 and a third time period T3. The first time period T1, the second time period T2 and the third time period T3 are also called as the first stage, the second stage and the third stage in the following description, respectively.

At the first time period T1, the first light-emitting signal EMIT1 and the first scanning signal S1 are set at a low level and the second scanning signal S2 and the second light-emitting signal EMIT2 are set at a high level.

Also referring to FIG. 1, the first transistor M1 may be turned on when the low level first light-emitting signal EMIT1 is applied to the gate electrode of the first transistor M1. The first reference voltage VDD may be transferred to the first node N1. In addition, the second transistor M2 may be turned on when the low level first scanning signal S1 is applied to the gate electrode of the second transistor M2. The second reference voltage Vref may be transferred to the second node N2. Thus, the voltage at the first node N1 may become $V_{N1}$=VDD, and the voltage at the second node N2 may become $V_{N2}$=Vref.

Further, because the second scanning signal S2 is set at a high level, the fourth transistor M4 and the fifth transistor M5 may be turned off. Because the second light-emitting signal EMIT2 is set at a high level, the sixth transistor M6, the seventh transistor M7, and the eighth transistor M8 may be turned off. The light-emitting element L may not emit light. The third transistor M3 may be turned off because the voltage at the second node N2 $V_{N2}$=Vref.

Returning to FIG. 2, at the second time period T2, the first light-emitting signal EMIT1 and the second scanning signal S2 are set at a low level, and the first scanning signal S1 and the second light-emitting signal EMIT2 are set at a high level.

Also referring to FIG. 1, the fifth transistor M5 may be turned on when the low level second scanning signal S2 is applied to the gate electrode of the fifth transistor M5. Thus, the gate electrode of the third transistor M3 and the second terminal of the third transistor M3 may get connected. That is, a current path may be formed between the second node N2 and the fourth node N4.

Meanwhile, the fourth transistor M4 may be turned on when the low level second scanning signal S2 is applied to the gate electrode of the fourth transistor M4. Thus, the data signal Vdata may be sequentially transferred through the fourth transistor M4, the third transistor M3, the fifth transistor M5 to the second node N2. The third transistor M3 may keep turned on until the voltage of the second node N2 becomes $V_{N2}$=Vdata−$V_{th}$ ($V_{th}$ is the threshold voltage of the third transistor M3). Thus, the voltage at the second node N2 may be fixed to $V_{N2}$=Vdata−$V_{th}$.

Further, because the first scanning signal S1 is set at a high level, the second transistor M2 may be turned off. Because the second light-emitting signal EMIT2 is set at a high level, the sixth transistor M6, the seventh transistor M7, and the eighth transistor M8 may be turned off. The light-emitting element L may not emit light. Because the first light-emitting signal EMIT1 is set at a low level, the first transistor M1 may be turned on, and the voltage at the first node N1 $V_{N1}$=VDD.

Returning to FIG. 2, at the third time period T3, the first light-emitting signal EMIT1, the first scanning signal S1 and the second scanning signal S2 are set at a high level, and the second light-emitting signal EMIT2 is set at a low level.

Also referring to FIG. 1, the sixth transistor M6 and the seventh transistor M7 may be both turned on when the low level second light-emitting signal EMIT2 is applied to the gate electrode of the sixth transistor M6 and the gate electrode of the seventh transistor M7, respectively. The first power supply voltage PVDD may be transferred through the seventh transistor M7 to the first node N1. The first transistor M1 may be turned off when the high level first light-emitting signal EMIT1 is applied to the gate electrode of the first transistor M1. That is, at the third time period T3, the voltage at the first node voltage may change to $V_{N1}$=PVDD. As a comparison, at the first time period T1 and the second time period T2, the voltage at the first node N1 $V_{N1}$=VDD. Meanwhile, at the third time period T3, the first power supply voltage PVDD may be transferred through the sixth transistor M6 to the third node N3, and the voltage at the third node N3 $V_{N3}$=PVDD.

Further, because the first scanning signal S1 is set at a high level, the second transistor M2 may be turned off. Because the second scanning signal S2 is set at a high level, the fourth transistor M4 and the fifth transistor M5 may be turned off. Because the second light-emitting signal EMIT2 is set at a low level, the eighth transistor M8 may be turned on. The light-emitting element L may emit light.

Due to a coupling effect of the first capacitor C1, the first terminal of the first capacitor C1 connected to the first node N1 may have a voltage change of (PVDD-VDD), which may cause a same voltage change of (PVDD-VDD) at the second terminal of the first capacitor C1 connected to the second node N2. Thus, at the third time period T3, the voltage at the second node N2 $V_{N2}$=Vdata−$V_{th}$+(PVDD−VDD)*$C_1/C_{total}$, where $C_1$ is the capacitance of the first capacitor C1, $C_{total}$ is a sum of the parasitic capacitance of the second transistor M2, the parasitic capacitance of the third transistor M3 and the parasitic capacitance of the fifth transistor M5.

Thus, a current flowing through the light-emitting element L may be calculated as $I_{OLED}$=K $(V_{SG}-V_{th})^2$, where Vs is the voltage at the first terminal of the third transistor M3 connected to a third node N3, $V_G$ is the voltage at the gate electrode of the third transistor M3 connected to the second node N2, $V_{SG}=V_S-V_G=V_{N3}-V_{N2}$=PVDD−[Vdata−$V_{th}$+(PVDD−VDD)*$C_1/C_{total}$] and $C_1 \approx C_{total}$, such that $V_{SG}$=VDD−Vdata+$V_{th}$ and accordingly $I_{OLED}$=K $(VDD-Vdata)^2$.

Because the parameter K may be determined by the third transistor M3 itself, such as a film dielectric constant, a channel width to length ratio, a carrier mobility of the transistor, etc., once the third transistor M3 is determined, K may also be determined. Thus, the illuminance of the light-emitting element L driven by the pixel circuit may be determined by a difference between the first reference voltage VDD and the first data signal Vdata.

The first reference voltage VDD may be different from the first power supply voltage PVDD. In particular, wiring of the first power supply voltage PVDD may be categorized as a power supply wiring, mainly supplying a current to the light-emitting element L. Thus, the current in the wiring of the first power supply voltage PVDD may be large across the entire display panel. If the current flowing through the light-emitting element L is related to the first power supply voltage PVDD, the large current in the wiring of the first power supply voltage PVDD may cause an obvious variation in the voltages applied to the pixels, which may result a luminance non-uniformity across the display screen of the display device.

As a comparison, wiring of the first reference voltage VDD and wiring of the data signal Vdata may not be categorized as the power supply wiring, the current in the wiring of the first reference voltage VDD and the current in the wiring of the data signal Vdata may be smaller than the current in the wiring of the first power supply voltage PVDD. Thus, the disclosed pixel circuit may enable a more uniform current distribution and accordingly a more uniform luminance distribution across the entire display panel.

Also referring to FIG. 1, when the pixel circuit drives the light-emitting element L, the first capacitor C1 may be able to compensate the threshold of the third transistor M3 through maintaining the electric potential of the second node N2. Meanwhile, the first capacitor C1 may create a coupling effect between the first node N1 and the second node N2 to eliminate the effects caused by the voltage drop in the wiring of the first power supply PVDD, thus the number of the transistors and the number of the capacitances may be reduced, and the pixel circuitry may be simplified accordingly.

It should be noted that, the illuminance of the light-emitting element L driven by the disclosed pixel circuit may be related to the first reference voltage VDD and the first data signal Vdata. To be more specific, the illuminance of the light-emitting element L driven by the disclosed pixel circuit may be determined by the difference between the first reference voltage VDD and the first data signal Vdata.

However, in certain embodiments, the illuminance of the light-emitting element driven by the pixel circuit may not be determined by the first reference voltage VDD, but determined by other voltage signals applied to the display panel, such as the second reference voltage Vref and etc. As discussed above, the wiring of the first power supply voltage PVDD may be categorized as a power supply wiring, mainly providing the current to the light-emitting element. The current in the wiring of the first power supply voltage PVDD may be large across the entire display panel.

Thus, as long as the illuminance of the light-emitting element driven by the pixel circuit is not determined by the first power supply voltage PVDD (i.e., not related to the first power supply voltage PVDD), the effects caused by the voltage drop in the wiring of the first power supply voltage PVDD may be eliminated. A more uniform current distribution and a more uniform luminance distribution across the entire display panel may be realized.

In the disclosed embodiments, the first power supply voltage PVDD may be set at a high level and the second power supply voltage PVEE may be set at a low level. The light-emitting element L may be a light-emitting diode.

Further, the first transistor M1, the second transistor M2, the third transistor M3, the fourth transistor M4, the fifth transistor M5, the sixth transistor M6, the seventh transistor M7 and the eighth transistor M8 may be all P-type transistors. All the transistors M1-M8 may be turned on when low level signals are applied to the gate electrodes of the transistors M1-M8 respectively, and all the transistors M1-M8 may be turned off when high level signals are applied to the gate electrodes of the transistors M1-M8 respectively.

In other embodiments, the first transistor M1, the second transistor M2, the third transistor M3, the fourth transistor M4, the fifth transistor M5, the sixth transistor M6, the seventh transistor M7 and the eighth transistor M8 may be all N-type transistors. However, the first power supply voltage PVDD and the second power supply voltage PVEE may need to be exchanged. That is, the first terminal of the sixth transistor M6 and the first terminal of the seventh transistor M7 may receive the second power supply voltage PVEE, while the second terminal of the light-emitting element L may receive the first power supply voltage PVDD. Meanwhile, all the transistors M1-M8 may be turned on when high level signals are applied to the gate electrodes of the transistors M1-M8 respectively, and all the transistors M1-M8 may be turned off when low level signals are applied to the gate electrodes of the transistors M1-M8 respectively. Thus, the driving scheme of the pixel circuit may be inverted as compared to the driving scheme of the pixel circuit in FIG. 2.

Figure 3:
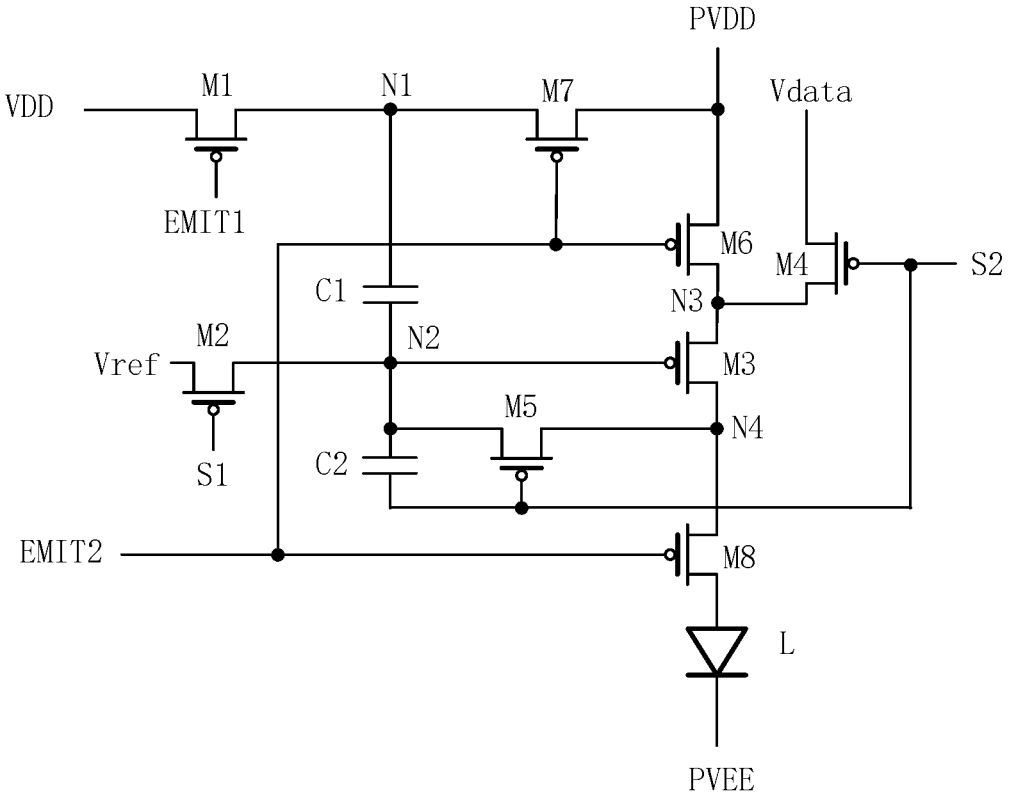
FIG. 3 illustrates another exemplary pixel circuit consistent with disclosed embodiments.

FIG. 3 illustrates another exemplary pixel circuit consistent with disclosed embodiments. Similarities between FIG. 1 and FIG. 3 may not be repeated here, while certain differences are further illustrated. As shown in FIG. 3, the pixel circuit may further include a second capacitor C2 having a first terminal connected to the gate electrode of the fifth transistor M5 and a second terminal connected to the second node N2. The driving scheme may be similar to the driving scheme in FIG. 2, similarities may not be repeated here, while certain differences are further illustrated.

As shown in FIG. 3, the first terminal of the second capacitor C2 may receive the second scanning signal S2 and the second terminal of the second capacitor C2 may be connected to the second node N2. Also referring to FIG. 2, the second scanning signal S2 is set at a low level at the second time period T2 and at a high level at the third time period T3. Due to the coupling effect of the second capacitor C2, a higher electric potential may be introduced to the second node N2 at the second stage. Thus, the third transistor M3 may be further closed when the higher electric potential at the second node N2 is applied to the gate electrode of third transistor M3. Thus, the light-emitting element L may have an improved dark state as well as an improved contrast ratio.

Figure 4:
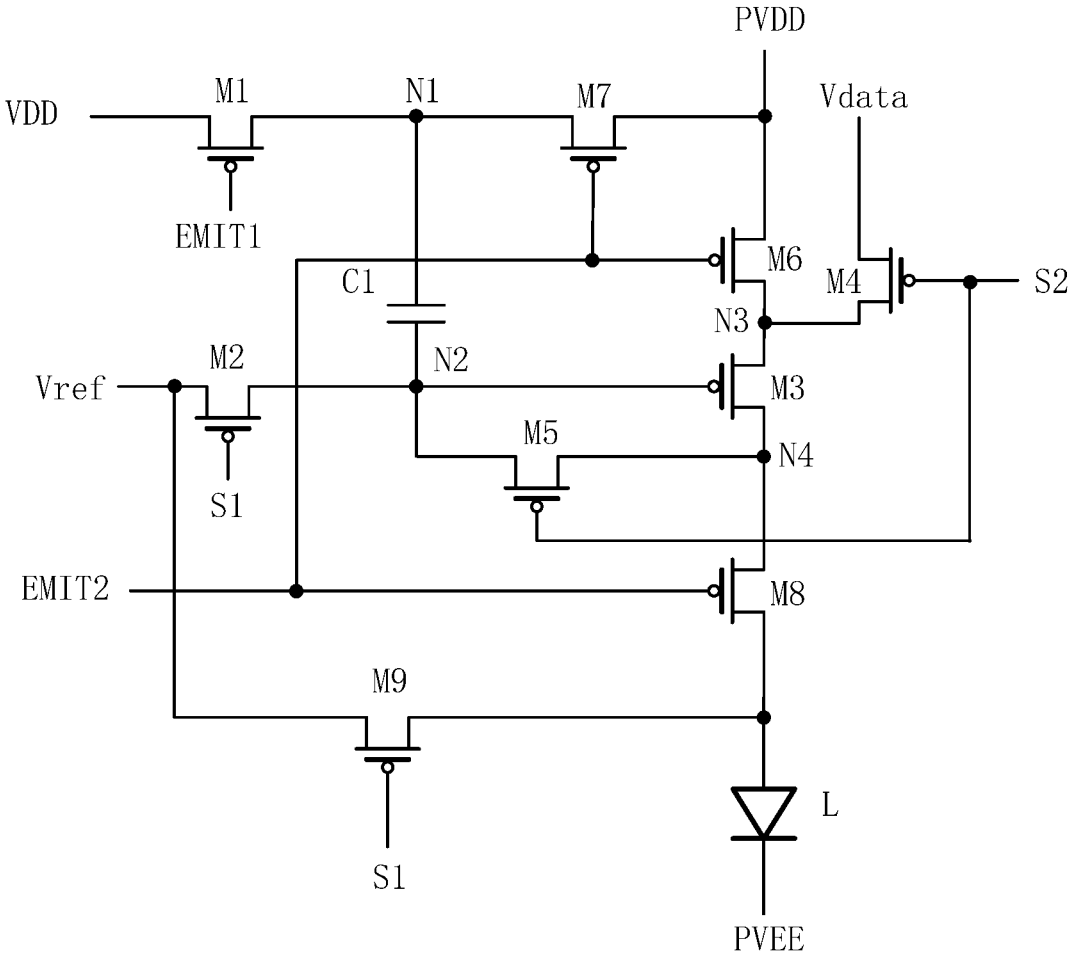
FIG. 4 illustrates another exemplary pixel circuit consistent with disclosed embodiments.

FIG. 4 illustrates another exemplary pixel circuit consistent with disclosed embodiments. Similarities between FIG. 1 and FIG. 4 may not be repeated here, while certain differences are further illustrated. As shown in FIG. 4, the pixel circuit may further include a ninth transistor M9. The ninth transistor M9 may have a gate electrode receiving the first scanning signal S1, a first terminal receiving the second reference voltage Vref, and a second terminal connected to the second terminal of the eighth transistor M8. The driving scheme may be similar to the driving scheme in FIG. 2, similarities may not be repeated here, while certain differences are further illustrated.

Also referring to FIG. 2, at the first time period T1, the first light-emitting signal EMIT1 and the first scanning signal S1 are set at a low level and the second scanning signal S2 and the second light-emitting signal EMIT2 are set at a high level. The ninth transistor M9 may be turned on when the first scanning signal S1 is applied to the gate electrode of the ninth transistor M9. The low level second reference voltage Vref may be transferred to the first terminal of the light-emitting element L through the ninth transistor M9 and then reset the light-emitting element L. Thus, the light-emitting element L may have an improved dark state as well as an improved contrast ratio.

It should be noted that, in the pixel circuit shown in FIG. 4, the first transistor M1, the second transistor M2, the third transistor M3, the fourth transistor M4, the fifth transistor M5, the sixth transistor M6, the seventh transistor M7 and the eighth transistor M8 may be all P-type transistors. In other embodiments, the first transistor M1, the second transistor M2, the third transistor M3, the fourth transistor M4, the fifth transistor M5, the sixth transistor M6, the seventh transistor M7 and the eighth transistor M8 may be all N-type transistors. However, the first power supply voltage PVDD and the second power supply voltage PVEE may need to be exchanged. That is, the first terminal of the sixth transistor M6 and the first terminal of the seventh transistor M7 may receive the second power supply voltage PVEE, while the second terminal of the light-emitting element L may receive the first power supply voltage PVDD. Meanwhile, the driving scheme of the pixel circuit may be inverted as compared to the driving scheme of the pixel circuit in FIG. 2.

Figure 5:
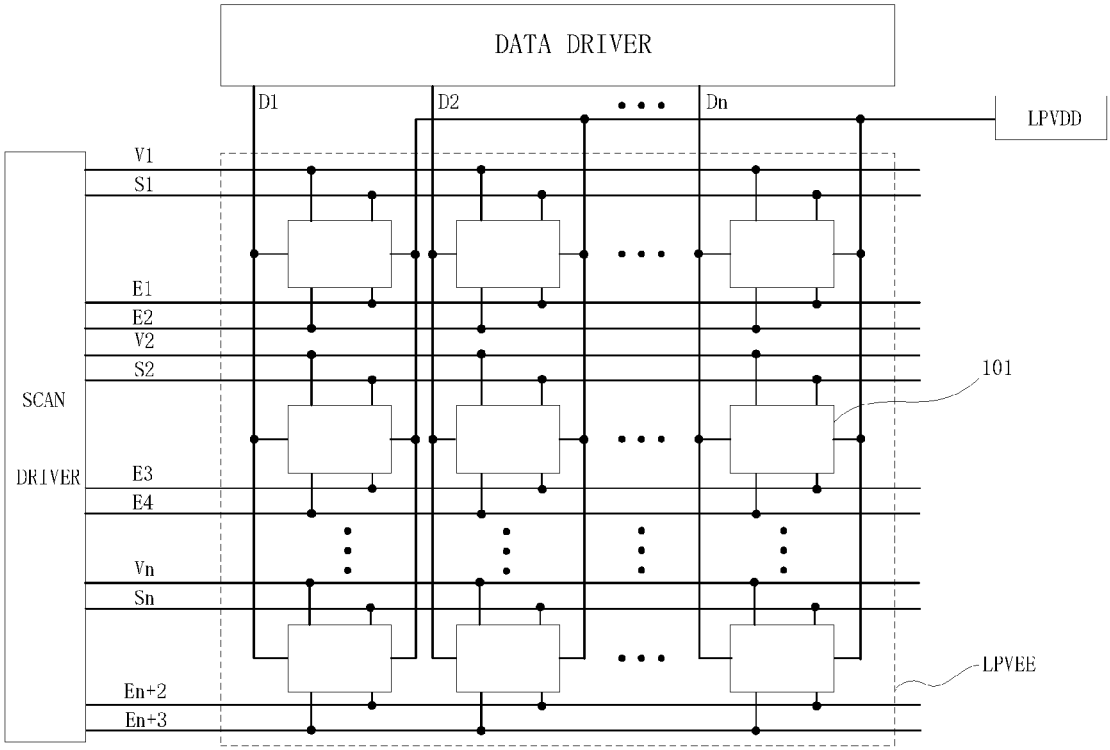
FIG. 5 illustrates an exemplary organic light-emitting display device consistent with disclosed embodiments.

FIG. 5 illustrates an exemplary organic light-emitting display device consistent with disclosed embodiments. As shown in FIG. 5, the organic light-emitting display device may include a plurality of scanning lines S1 to Sn transferring a scanning signals a plurality of scan lines D1 to Dn transferring a data signal, a plurality of first reference voltage scanning lines V1 to Vn transferring a first reference voltage, a plurality of first light-emitting signal lines E1 to En+2 transferring a first light-emitting signal and a plurality of second light-emitting signal lines E2 to En+3 transferring a second light-emitting signal.

The organic light-emitting display device may further include a first power supply LPVDD supplying a first power supply voltage and a second power supply LPVEE supplying a second power supply voltage. The scanning lines may intersect or cross with the data lines. A plurality of pixel circuits consistent with disclosed embodiments may be disposed at interactions or crossings of the scanning lines S1 to Sn and the data lines D1 to Dn.

The description of the disclosed embodiments is provided to illustrate the present invention to those skilled in the art.

Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A pixel circuit, comprising:

a first transistor having a gate electrode receiving a first light-emitting signal, a first terminal receiving a first reference voltage, and a second terminal connected to a first node;

a second transistor having a gate electrode receiving a first scanning signal, a first terminal receiving a second reference voltage, and a second terminal connected to a second node;

a third transistor having a gate electrode connected to the second node, a first terminal connected to a third node and a second terminal connected to a fourth node;

a fourth transistor having a gate electrode receiving a second scanning signal, a first terminal receiving a data signal, and a second terminal connected to the third node;

a fifth transistor having a gate electrode receiving the second scanning signal, a first terminal connected to the fourth node, and a second terminal connected to the second node;

a sixth transistor having a gate electrode receiving a second light-emitting signal, a first terminal receiving a first power supply voltage, and a second terminal connected to the third node;

a seventh transistor having a gate electrode receiving the second light-emitting signal, a first terminal receiving the first power supply voltage, and a second terminal connected to the first node;

an eighth transistor having a gate electrode receiving the second light-emitting signal, and a first terminal connected to the fourth node;

a light-emitting element has a first terminal connected to the second terminal of the eighth transistor and a second terminal receiving a second power supply voltage; and a first capacitor having a first terminal connected to the first node and a second terminal connected to the second node.

2. The pixel circuit according to claim 1, further including:

a second capacitor having a first terminal connected to the gate electrode of the fifth transistor and a second terminal connected to the second node.

3. The pixel circuit according to claim 1, further including:

a ninth transistor having a gate electrode receiving the first scanning signal, a first terminal receiving the second reference voltage, and a second terminal connected to the second terminal of the eighth transistor.

4. The pixel circuit according to claim 2, further including:

the ninth transistor having the gate electrode receiving the first scanning signal, the first terminal receiving the second reference voltage, and the second terminal connected to the second terminal of the eighth transistor.

5. The pixel circuit according to claim 1, wherein:

the first power supply voltage is set at a high level and the second power supply voltage is set at a low level.

6. The pixel circuit according to claim 1, wherein:

the first transistor, the second transistor, the third transistor, the fourth transistor, the fifth transistor, the sixth transistor, the seventh transistor and the eighth transistor are all P-type transistors.

7. The pixel circuit according to claim 3, wherein:

the first transistor, the second transistor, the third transistor, the fourth transistor, the fifth transistor, the sixth transistor, the seventh transistor, the eighth transistor and the ninth transistor are all P-type transistors.

8. The pixel circuit according to claim 4, wherein:

the first transistor, the second transistor, the third transistor, the fourth transistor, the fifth transistor, the sixth transistor, the seventh transistor, the eighth transistor, and the ninth transistor are all P-type transistors.

9. The pixel circuit according to claim 1, wherein the first capacitor is further configured to:

compensate a threshold of the third transistor through maintaining an electric potential at the second node, and eliminate effects caused by a voltage drop in a wiring of the first power supply through generating a coupling effect between the first node and the second node.

10. The pixel circuit according to claim 1, wherein:

the light-emitting element is a light-emitting diode.

11. An organic light-emitting display device, comprising:

a plurality of scanning lines transferring a scanning signal;

a plurality of data lines transferring of a data signal;

a plurality of pixel circuits disposed at interactions of the plurality of scanning lines and the plurality of data lines; and wherein the pixel circuit comprises a first transistor having a gate electrode receiving a first light-emitting signal, a first terminal receiving a first reference voltage, and a second terminal connected to a first node; a second transistor having a gate electrode receiving a first scanning signal, a first terminal receiving a second reference voltage, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage, and a second terminal connected to the third node; a seventh transistor having a gate electrode receiving the second light-emitting signal, a first terminal receiving the first power supply voltage, and a second terminal connected to the first node; and an eighth transistor having a gate electrode receiving the second light-emitting signal, a first terminal connected to the fourth node; a light-emitting element having a first terminal connected to the second terminal of the eighth transistor and a second terminal receiving a second power supply voltage; and a first capacitor having a first terminal connected to the first node and a second terminal connected to the second node.

12. A driving method of a pixel circuit driving a light-emitting element comprising a first transistor having a gate electrode receiving a first light-emitting signal, a first terminal receiving a first reference voltage VDD, and a second terminal connected to a first node; a second transistor having a gate electrode receiving a first scanning signal, a first terminal receiving a second reference voltage Vref, and a second terminal connected to a second node; a third transistor having a gate electrode connected to the second node, a first terminal connected to a third node and a second terminal connected to a fourth node; a fourth transistor having a gate electrode receiving a second scanning signal, a first terminal receiving a data signal Vdata, and a second terminal connected to the third node; a fifth transistor having a gate electrode receiving the second scanning signal, a first terminal connected to the fourth node, and a second terminal connected to the second node; a sixth transistor having a gate electrode receiving a second light-emitting signal, a first terminal receiving a first power supply voltage PVDD, and a second terminal connected to the third node; a seventh transistor having a gate electrode receiving the second light-emitting signal, a first terminal receiving the first power supply voltage PVDD, and a second terminal connected to the first node; an eighth transistor having a gate electrode receiving the second light-emitting signal, and a first terminal connected to the fourth node; a light-emitting element having a first terminal connected to the second terminal of the eighth transistor and a second terminal receiving a second power supply voltage; and a first capacitor having a first terminal connected to the first node and a second terminal connected to the second node, the method comprising:

at a first time period, providing the first light-emitting signal to the first transistor, such that the first reference voltage VDD is transferred to the first node, providing the first scanning signal to the second transistor, such that the second reference voltage Vref is transferred to the second node;

at a second time period, providing the second scanning signal to the fourth transistor, such that the data signal is transferred to the third node, providing the second scanning signal to the fifth transistor, such that the gate electrode of the third transistor and the second terminal of the third transistor are connected until a voltage of the second node is equal to a difference between the data signal and a threshold of the third transistor; and at a third time period, providing the second light-emitting signal to the seventh transistor, such that the first power supply voltage PVDD is transferred to the first node, the second node has a same electric potential change as the first node because of a coupling effect of the first capacitor, and a brightness of the light-emitting element is not determined by the first reference voltage VDD.

13. The pixel circuit driving method according to claim 12, wherein providing the first light-emitting signal to the first transistor, such that the first reference voltage VDD is transferred to the first node, providing the first scanning signal to the second transistor, such that the second reference voltage Vref is transferred to the second node further includes:

turning on the first transistor when the first light-emitting signal is at a low level is at a low level, such that the first reference voltage VDD is transferred to the first node; and turning on the second transistor when the first scanning signal is at a low level, such that the second reference voltage Vref is transferred to the second node.

14. The pixel circuit driving method according to claim 13, wherein:

the voltage at the first node is $V_{N1}$=VDD and the voltage at the second node is $V_{N2}$=Vref.

15. The pixel circuit driving method according to claim 12, wherein providing the second scanning signal to the fourth transistor, such that the data signal is transferred to the third node, providing the second scanning signal to the fifth transistor, such that the gate electrode of the third transistor and the second terminal of the third transistor are connected until a voltage of the second node is equal to a difference between the data signal and a threshold of the third transistor further includes:

turning on the fifth transistor and the four transistor when the second scanning signal is at a low level, such that a current path is formed between the second node and the fourth node, the data signal Vdata is transferred through the fourth transistor, the third transistor and the fifth transistor to the second node, the gate electrode of the third transistor and the second terminal of the third transistor are disconnected when the voltage at the second node becomes $V_{N2}$=Vdata−$V_{th}$, where $V_{th}$ is the threshold voltage of the third transistor.

16. The pixel circuit driving method according to claim 15, wherein:

the voltage at the second node is fixed as $V_{N2}$=Vdata−$V_{th}$, where $V_{th}$ is the threshold voltage of the third transistor.

17. The pixel circuit driving method according to claim 12, wherein providing the second light-emitting signal to the seventh transistor, such that the first power supply voltage PVDD is transferred to the first node, the second node has a same electric potential change as the first node because of a coupling effect of the first capacitor, and a brightness of the light-emitting element is not determined by the first reference voltage VDD further includes:

turning on the seventh transistor when the second light-emitting signal is at a low level, such that the first power supply voltage PVDD is transferred through the seventh transistor to the first node; and turning on the sixth transistor when the second light-emitting signal is at a low level, such that the first power supply voltage PVDD is transferred through the sixth transistor to the third node.

18. The pixel circuit driving method according to claim 17, wherein:

the voltage at the first node $V_{N1}$=PVDD;

the voltage at the third node $V_{N3}$=PVDD; and the voltage at the second node N2 $V_{N2}$=Vdata−$V_{th}$+(PVDD−VDD)*$C_1/C_{total}$, where $C_1$ is the capacitance of the first capacitor, $C_{total}$ is a sum of a parasitic capacitance of the second transistor, a parasitic capacitance of the third transistor and a parasitic capacitance of the fifth transistor, $V_{th}$ is the threshold voltage of the third transistor.

19. The pixel circuit driving method according to claim 18, wherein:

a current flowing through the light-emitting element is $I=K\ (V_{SG}-V_{th})^2$, where Vs is the voltage at the first terminal of the third transistor connected to the third node, $V_G$ is the voltage at the gate electrode of the third transistor connected to the second node, such that $V_{SG}=V_S-V_G=V_{N3}-V_{N2}$=PVDD−[Vdata−$V_{th}$+(PVDD−VDD)*$C_1/C_{total}$].

20. The pixel circuit driving method according to claim 19, wherein:

the current flowing through the light-emitting element can be written as $I=K\ (VDD-Vdata)^2$ when $C_1 \approx C_{total}$, where K is parameter dependent on the third transistor.

* * * * *